US006024238A

United States Patent [19]

Jaros

[11] Patent Number: 6,024,238

[45] Date of Patent: Feb. 15, 2000

[54] TRASH RECEPTACLE WITH A LID DAMPER

[75] Inventor: Philip Jaros, Gloversville, N.Y.

[73] Assignee: White Mop Wringer Company, Tampa, Fla.

[21] Appl. No.: 08/944,151

[22] Filed: Oct. 6, 1997

[51] Int. Cl.[7] ..... B65D 43/26

[52] U.S. Cl. ..... 220/264; 220/263; 220/828; 220/849; 220/378; 220/908; 16/84

[58] Field of Search ..... 49/137; 16/84; 220/262–264, 908, 335, 378, 344, 810, 828, 849

[56] References Cited

U.S. PATENT DOCUMENTS

| | | | |
|---|---|---|---|
| 1,975,554 | 10/1934 | Morrissey | 220/344 X |
| 2,033,295 | 3/1936 | Parkin | 220/344 |
| 2,246,975 | 6/1941 | Geibel | 220/264 X |
| 2,550,493 | 4/1951 | Ohlson | 220/344 X |
| 2,663,529 | 12/1953 | Lyttaker | 220/264 X |
| 2,836,288 | 5/1958 | Atchison | 220/344 X |
| 3,641,706 | 2/1972 | Carlson et al. | 16/84 X |
| 3,850,336 | 11/1974 | Acosta | 220/335 |
| 4,775,066 | 10/1988 | Keppler | 220/500 X |
| 4,892,218 | 1/1990 | Reiling | 220/908 X |
| 4,953,740 | 9/1990 | Koda | 220/263 |
| 5,011,036 | 4/1991 | Souza et al. | 220/263 |
| 5,084,939 | 2/1992 | Garman | 16/84 |
| 5,125,526 | 6/1992 | Sumanis | 220/264 X |
| 5,163,574 | 11/1992 | Sosan | 220/264 |
| 5,218,784 | 6/1993 | Pollock | 220/264 X |
| 5,220,706 | 6/1993 | Bivens | 16/84 X |
| 5,471,708 | 12/1995 | Lynch | 16/84 X |
| 5,531,348 | 7/1996 | Baker et al. | 220/264 |
| 5,566,403 | 10/1996 | Black et al. | 220/264 X |
| 5,671,859 | 9/1997 | Sheu et al. | 220/263 |

OTHER PUBLICATIONS

"AVM Standard Damper Line Specification Sheet," AVM—an Arvin Company (Last Rev. Apr. 4, 1995).

*Primary Examiner*—Stephen P. Garbe
*Assistant Examiner*—Robin Hylton
*Attorney, Agent, or Firm*—Fish & Neave; G. Victor Treyz

[57] ABSTRACT

A trash receptacle with a slowly closing lid is provided. A band of elastomeric material is provided around the rim of the trash receptacle opening to soften contact between the lid and the receptacle. The lid of the trash receptacle may be opened by depressing a foot pedal. When it is desired to close the trash receptacle lid, the foot pedal may be released. This causes the lid to close under its own weight. The lid has a damper arrangement that retards movement of the lid as the lid closes. The slow movement of the lid that is provided by the damper arrangement allows the lid to close quietly and safely by itself.

13 Claims, 3 Drawing Sheets

14
38
35
32
42
34
16
36
15
12
40
28
24

TRASH RECEPTACLE WITH A LID DAMPER

BACKGROUND OF THE INVENTION

This invention relates to trash receptacles, and particularly to trash receptacles with lids.

Trash receptacles for commercial and heavy-duty use must generally withstand a good deal of abuse. Such trash receptacles are therefore solidly designed and have heavy lids. In some situations, such as in hospital settings, the weight of the lid provides assurance that potentially dangerous waste has been disposed of securely.

However, the sturdy construction and heavy weight of such trash receptacle lids can cause problems. For example, such lids typically make a considerably amount of noise when they are closed. This can be a serious disturbance, particularly in a quiet hospital setting. In addition, small children and others risk hurting themselves by catching a finger or hand in a closing lid.

Although trash receptacle lids can be lowered slowly by hand, people typically do not want to stoop over to lower a lid nor do they want to touch the potentially dirty surfaces of a lid to lower it. Many trash receptacles have lids that may be raised by a foot pedal. However, it is generally impractical to use a foot pedal to slowly lower a lid and most people make no attempt to do so.

It is therefore an object of the invention to provide a trash receptacle with a lid that closes slowly and quietly by itself.

SUMMARY OF THE INVENTION

These and other objects of the invention are accomplished in accordance with the principles of the invention by providing a trash receptacle with a slowly closing lid. The trash receptacle preferably has a trash container body to which the lid is mounted with a hinge. A band of elastomeric material is provided around the upper lip of the trash container body to soften contact between the lid and the receptacle when the lid is closed.

The lid of the trash receptacle may be opened by depressing a foot pedal. When it is desired to close the trash receptacle lid, the foot pedal may be released. This causes the lid to close under its own weight. The lid has a gas damper or other suitable damper arrangement that retards movement of the lid as the lid closes. The slow movement of the lid that is provided by the damper arrangement allows the lid to close quietly and safely by itself.

Further features of the invention, its nature and various advantages will be more apparent from the accompanying drawings and the following detailed description of the preferred embodiments.

DETAILED DESCRIPTION OF THE PREFERRED EMBODIMENT

Figure 1:
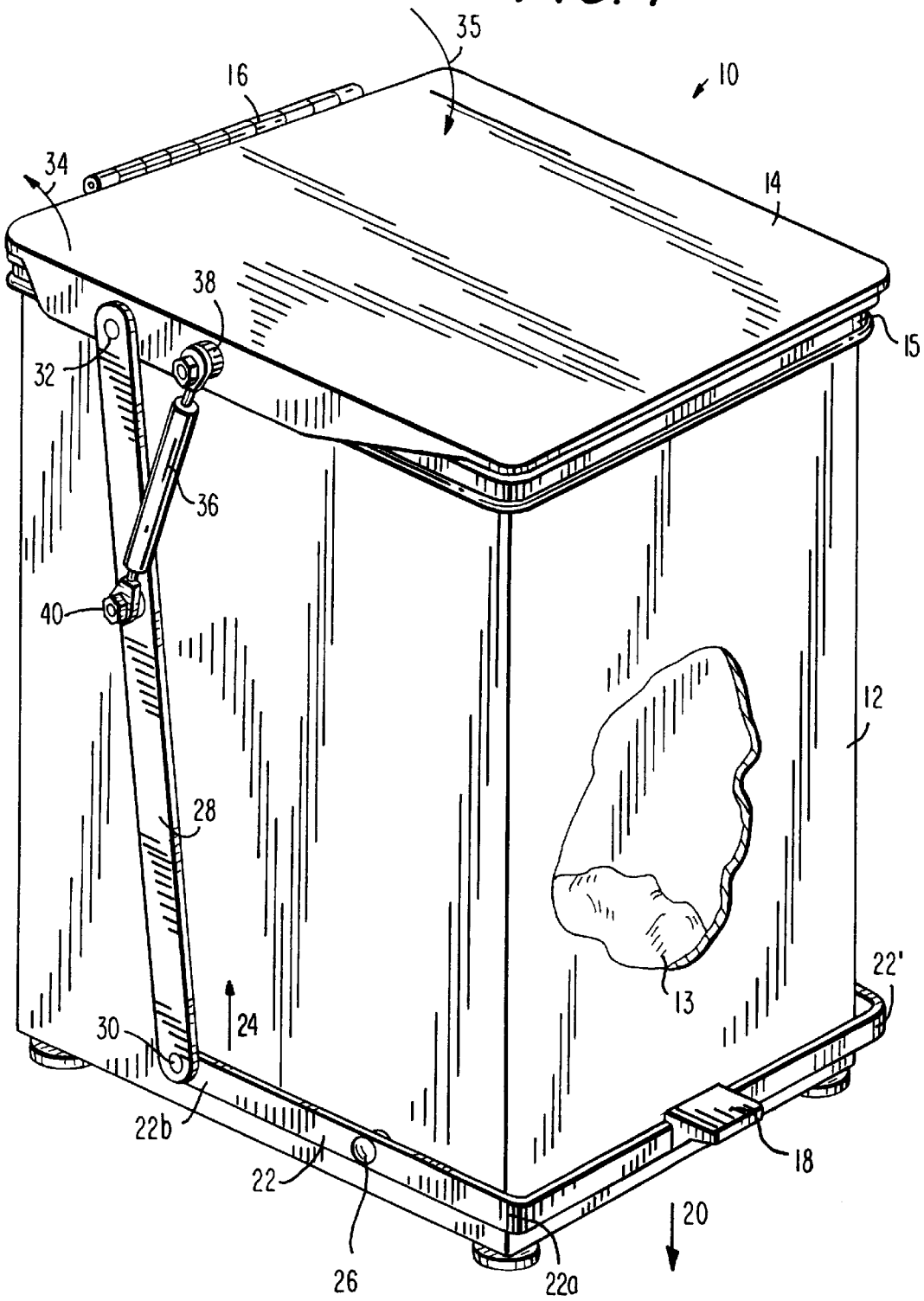
FIG. 1 is a perspective view of an illustrative trash receptacle with a lid damper arrangement in accordance with the present invention.

An illustrative trash receptacle 10 in accordance with the present invention is shown in FIG. 1. Trash receptacle 10 has trash container body 12, which is hollow and holds trash 13. Lid 14 is mounted to body 12 with hinge 16. A preferable material for forming lid 14 is a metal such as 0.05 inch thick steel.

A band 15 of vinyl or other suitable elastomeric material is preferably provided around the periphery of the top of trash container body 12 to help reduce noise when lid 14 is closed by softening the contact between lid 14 and trash container body 12. The seal provided by band 15 also helps to prevent odors from leaking out of trash container body 12.

Lid 14 may be lifted manually if desired. Preferably, however, trash receptacle 10 has a foot pedal 18. When foot pedal 18 is depressed in direction 20, end 22*a* of horizontal member 22 is moved downward in direction 20. This causes end 22*b* of horizontal member 22 to pivot upward in direction 24 about pivot member 26, which is mounted to trash container body 12. (If desired, pivot member 26 may include a rod that passes beneath the hollow inner portion of trash container body 12 and provides support for both horizontal member 22 and a corresponding horizontal member 22' on the opposite side of trash receptacle 10.) As end 22*b* moves upward in direction 24, vertical member 28, which is coupled to horizontal member 22 at pivot connection 30 (not connected to trash container body 12), is also moved upward in direction 24. Vertical member 28 is connected to lid 14 at pivot connection 32, so the movement of vertical member 28 upward in direction 24 causes lid 14 to pivot at hinge 16 and open in direction 34.

When the downward pressure on pedal 18 is removed, lid 14 closes in direction 35 under its own weight. In order to retard the movement of lid 14 as it closes, trash receptacle 10 is provided with a damper such as gas damper 36. Suitable gas dampers 36 are available from AVM Inc. of Marion, S.C. If desired, other types of dampers, such as hydraulic or mechanical dampers, may be used.

One end of damper 36 is connected to lid 14 at pivot connection 38. The other end of damper 36 is preferably connected to member 28 at pivot connection 40, but may alternatively be connected to trash container body 12 if desired.

Figure 2:
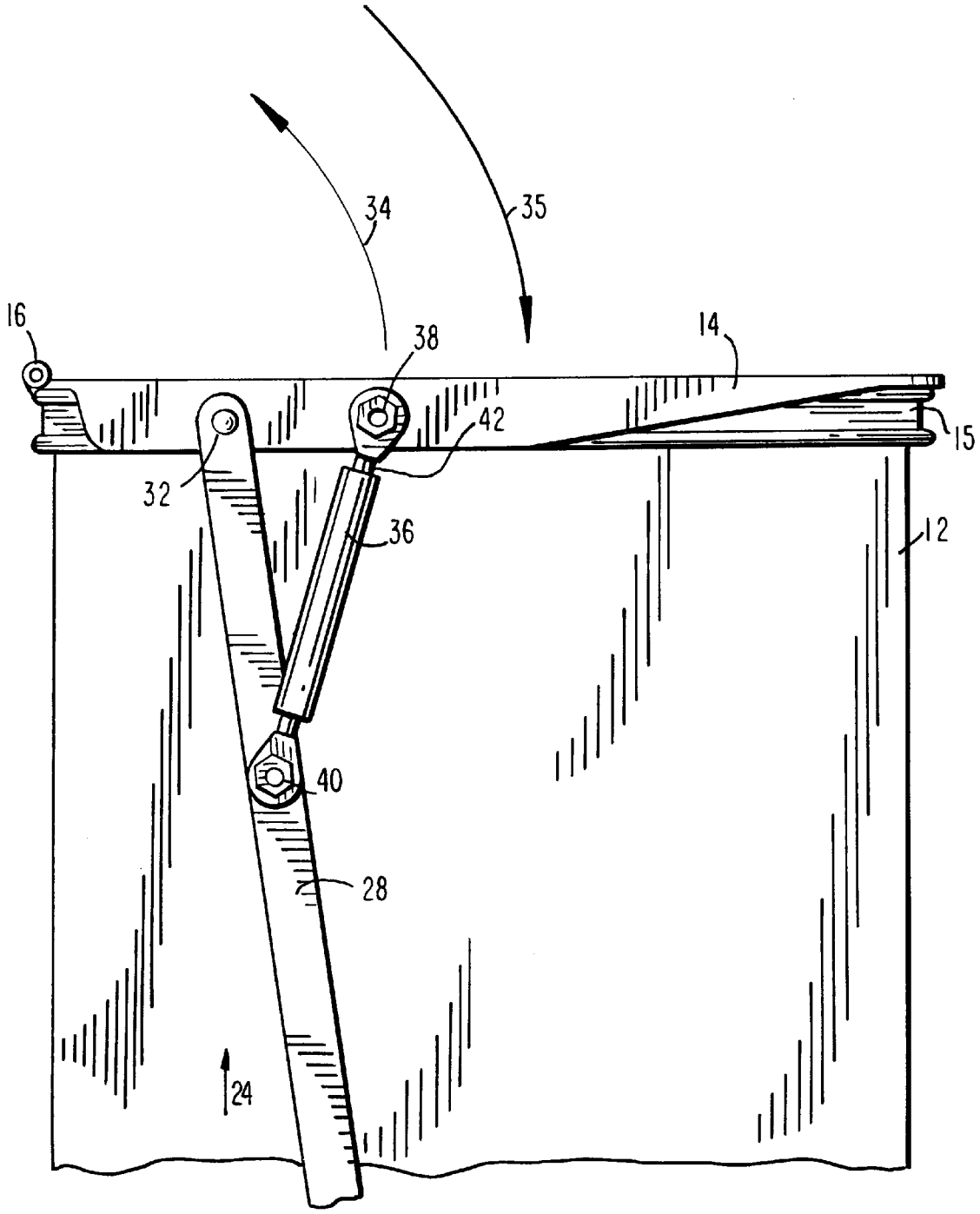
FIG. 2 is a side view of the illustrative trash receptacle of FIG. 1 in which the lid of the receptacle is in the closed position.
Figure 3:
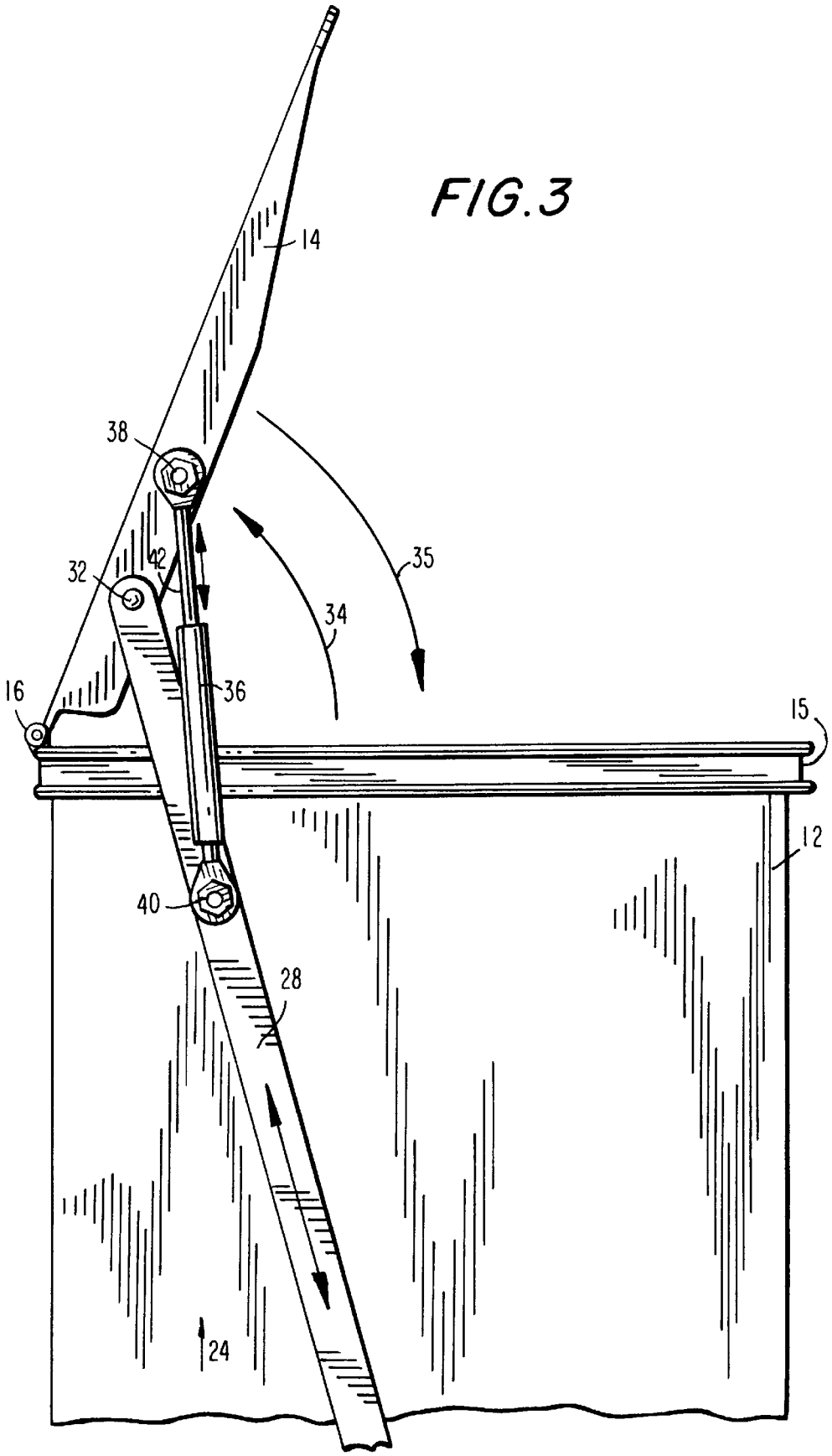
FIG. 3 is a side view of the illustrative trash receptacle of FIG. 1 in which the lid of the receptacle is in the open position.

As shown in FIG. 2, when lid 14 is closed, shaft 42 of damper 36 is retracted within damper 36. When lid 14 is opened in direction 34 by depressing pedal 18 of FIG. 1, shaft 42 extends out of damper 36, as shown in FIG. 3. Releasing pedal 18 causes lid 14 to close under its own weight. As lid 14 closes, shaft 42 is driven into gas damper 36. Gas damper 36 retards shaft 42, thereby slowing the movement of lid 14 and allowing lid 14 to close quietly and safely.

If desired, the maximum extent to which shaft 42 is allowed to extend out of gas damper 36 may be limited so that lid 14 cannot open more than about 90° in direction 34. This prevents lid 14 from being accidentally opened so far that it falls behind trash container body 12.

It will be understood that the foregoing is merely illustrative of the principles of this invention, and that various modifications can be made by those skilled in the art without departing from the scope and spirit of the invention.

The invention claimed is:

1. A trash receptacle comprising:

a trash container body;

a lid pivotably mounted to the trash container body for movement between an open position in which trash may be claced into the trash container body and a closed position in which trash is enclosed within the trash container body;

a damper connected to the lid for retarding movement of the lid as the lid closes; and a vertical member pivotably connected to the lid for opening the lid wherein one end of the damper is connected to the lid and the other end of the damper is connected to the vertical member.

2. The trash receptacle defined in claim 1 further comprising a foot pedal for opening the lid.

3. The trash receptacle defined in claim 1 wherein the damper is a gas damper.

4. The trash receplacle defined in claim 1 wherein the lid is made of metal and has a thickness in the range of 0.015 to 0.15 inches.

5. The trash receptacle defined in claim 1 further comprising a hinge for forming the pivotable connection between the lid and the trash container body.

6. The trash receptacle defined in claim 1 wherein the trash container body, has an open, upper end, the trash receptacle further comprising an elastomeric band around the periphery of the open, upper end to soften contact between the lid and the trash container body when the lid is closed.

7. The trash receptacle defined in claim 1 wherein the lid is made of metal.

8. A trash receptacle comprising:

a trash container body;

a lid pivotably mounted to the trash container body for movement between an open position in which trash may be placed into the trash container body and a closed position in which trash is enclosed within the trash container body;

a dcamper connected to the lid for retarding movement of the lid as the lid closes, wherein the damper has a first end and a second end, the first end of the damper being connected to the lid and the second end of the damper being connected to the vertical member;

a foot pedal;

a horizontal member pivotably mounted to said trash container body; and a vertical member connected between the horizontal member and the lid, wherein depressant the foot pedal causes the horizontal member to pivot and drive the vertical member upwards to open the lid.

9. The trash receptacle defined in claim 8 wherein the damper is a gas damper.

10. The trash receptacle defined in claim 8 wherein the lid is made of metal.

11. The trash receptacle defined in claim 8 wherein the lid is made of metal and has a thickness in the range of 0.015 to 0.15 inches.

12. The trash receptacle defined in claim 8 further comprising a hinge for forming the pivotable connection between the lid and the trash container body.

13. The trash receptacle defined in claim 8 wherein the trash container body has an open, upper end, the trash receptacle further comprising an elastomeric band around the periphery of the open, upper end to soften contact between the lid and the trash container body when the lid is closed.

* * * * *